United States Patent [19]

Mizuno et al.

[11] Patent Number: 5,026,630

[45] Date of Patent: Jun. 25, 1991

[54] SELF-PROCESSING PHOTOGRAPHIC FILM UNIT WITH NONWOVEN CLOTH IN TRAP

[75] Inventors: Kazunori Mizuno; Kenji Sashihara, both of Kanagawa, Japan

[73] Assignee: Fuji Photo Film Co., Ltd., Kanagawa, Japan

[21] Appl. No.: 532,421

[22] Filed: Jun. 4, 1990

[30] Foreign Application Priority Data

Jun. 2, 1989 [JP] Japan ..... 1-141311
Jun. 2, 1989 [JP] Japan ..... 1-141312
Jun. 2, 1989 [JP] Japan ..... 1-141313

[51] Int. Cl.[5] ..... G03C 3/00; G03C 5/54

[52] U.S. Cl. ..... 430/498; 430/209; 430/216

[58] Field of Search ..... 430/209, 216, 498

[56] References Cited

U.S. PATENT DOCUMENTS

| | | | |
|---|---|---|---|
| 2,627,460 | 2/1953 | Land | 430/209 |
| 2,686,716 | 8/1954 | Land | 430/209 |
| 2,983,606 | 5/1961 | Rogers | 430/224 |
| 3,294,538 | 12/1966 | Downey | 430/209 |
| 3,362,819 | 1/1968 | Land | 430/216 |
| 3,589,904 | 6/1971 | Chen | 430/207 |
| 3,615,436 | 10/1971 | Campbell | 430/209 |
| 3,615,540 | 10/1971 | Land et al. | 430/209 |
| 3,619,193 | 11/1971 | Knight | 430/209 |
| 3,761,269 | 9/1973 | Campbell | 430/216 |
| 4,352,879 | 10/1982 | Hara | 430/209 |
| 4,598,041 | 7/1986 | Hara et al. | 430/209 |

FOREIGN PATENT DOCUMENTS

| | | |
|---|---|---|
| 2290699 | 6/1976 | France . |
| 52-11027 | 1/1977 | Japan . |
| 58-10509 | 2/1983 | Japan . |
| 60-140336 | 7/1985 | Japan . |
| 62-91940 | 4/1987 | Japan . |

*Primary Examiner*—Richard L. Schilling
*Attorney, Agent, or Firm*—Sughrue, Mion, Zinn, Macpeak & Seas

[57] ABSTRACT

A self-processing photographic film unit has a trap member using a nonwoven cloth in order to catch surplus processing solution. This nonwoven cloth is provided with a polymer having carboxyl groups, and a hardening agent for hardening the polymer in order to prevent leakage and change of color to a frame portion of an image forming plane. A nonwoven cloth according to another embodiment includes a fiber of duplex structure which comprises an external layer of a hydrophilic cross linkage polymer and an internal layer of an acrylonitrile type polymer. A further embodiment includes a nonwoven cloth having dimensions of individual gaps or density which are changed stepwise or continuously. This nonwoven cloth is stored in the trap section so that a portion having a small density or large individual gaps is disposed on the inlet side.

25 Claims, 4 Drawing Sheets

SELF-PROCESSING PHOTOGRAPHIC FILM UNIT WITH NONWOVEN CLOTH IN TRAP

BACKGROUND OF THE INVENTION

This invention relates to a self-processing photographic film unit, and more particularly to a trap member for catching surplus processing solution.

A self-processing photographic film unit (hereinafter, a film unit) which commonly is called an instant film, as shown in FIG. 7, includes a photosensitive sheet 1 having a photosensitive layer and an image receiving layer, a transparent coVer sheet 2, and a mask sheet 3. The mask sheet 3 has an exposure opening 3A and is attached to the photosensitive sheet 1 in such a manner as to block the opening 3A from the back. Also, the mask sheet 3 and the cover sheet 2 are attached through a spacer rail 4, thereby to form a predetermined distance between the photosensitive sheet 1 and the cover sheet 2.

The front end portion of the mask sheet 3 is folded back inwardly in order to wrap a processing solution container 5 which stores processing solution. The edge of the front end portion is attached to the surface of the cover sheet 2. The rear end portion of the mask sheet 3 is folded back inwardly in order to wrap a trap member 6 for catching surplus processing solution. The edge of the rear end portion is attached to the cover sheet 2. The foregoing arrangement forms a trap section 7 for storing the trap member 6 and catching the surplus processing solution. A more detailed description of the construction of this film unit is provided, for example, in Japanese Patent Laid-open Publication No. Sho 62-91940.

As is known, a film unit is loaded in an instant camera, and the photosensitive sheet 1 is exposed by light passed through the exposure opening 3A when the shutter is operated. After exposure, the film unit is passed between a pair of processing solution developing rollers with its front end 8A ahead, and is discharged from the instant camera. The processing solution developing rollers pressurize the processing solution container 5, push out the processing solution stored therein, and spread it in a space formed between the photosensitive sheet 1 and the cover sheet 2 over a uniform width. The photosensitive sheet 1 is processed by such spread processing solution, and as a result, a positive image appears on its back side.

When the processing solution is being spread, surplus processing solution enters the trap section 7 and is caught by the trap member 6 contained therein. Just when the surplus processing solution is processed, air contained in the space also is pushed, flows out toward the trap portion 7 together with the surplus processing solution, and then is discharged through a plurality of air discharging holes 9 which are formed in the mask sheet 3.

Examples of the trap section are disclosed in at in U.S. Pat. Nos. 2,627,460, 3,589,904, 3,615,540, and 3,619,193. The described trap structures are improved in that they enhance smooth discharge of air, but are not intended to ensure perfect protection from leakage of the surplus processing solution caused by various conditions resulting from using the camera or preserving the film unit after taking pictures. Therefore, when processing is performed under summertime conditions, when the temperature is 40° C. and the relative humidity is 90%, surplus processing solution may leak out through air discharging holes.

Also, in a film unit disclosed in Japanese Patent Laid-open Publication No. Sho 52-11027, if the film unit is kept at a temperature of 60° C. and a relative humidity of 80%, the surplus processing solution becomes fluid. As a result, part of the surplus processing solution leaks from the trap section into the exposure opening. An image dye precursor contained in the photosensitive layer is decomposed and scattered with the leaked surplus processing solution, and a change of color occurs in a frame portion of an image forming plane defined with the edge of the exposure opening. The change of color problem in the frame portion also occurs in a trap structure comprising a water absorption layer, a neutralization layer connected therewith, and a plastic net connected with them.

Also, Japanese Patent Laid-open Publication No. Sho 60-140336 describes the use of a water soluble matrix as a trap member, so that the effective catching quantity of the surplus processing solution is increased without increasing the thickness of the trap structure, in order to prevent leakage of the surplus processing solution from the air holes. Although this film unit is capable of preventing leakage when the processing solution is spread, leakage sometimes occurs from discharge air holes when a strong pressure is applied to the trap section.

SUMMARY OF THE INVENTION

In view of the foregoing, a principal object of the present invention is to provide a film unit which is capable of preventing leakage of surplus processing solution and change of color of a frame portion of an image forming plane, even in conditions of high temperature and/or high humidity.

Another object of the invention is to provide a film unit in which no leakage occurs even if a strong pressure is applied to a trap section after processing the film unit.

A further object of the invention is to provide a film unit having simplified construction in order to reduce manufacturing cost.

In order to achieve these and other objects and advantages, a first embodiment of the invention includes a trap member provided with an alkali neutralizing agent of polymer having carboxyl groups, 1 mol % or more of a hardening agent relative to cross linkage groups in order to harden the polymer, and a nonwoven cloth or fabric attached to the alkali neutralizing agent and hardening agent. The nonwoven cloth preferably has a density within a range of 0.07 to 0.40 g/cm$^3$.

When the processing solution container is ruptured by a roller, etc. after taking pictures, the processing solution spreads over a photosensitive layer to perform developing. Surplus processing solution is caught by the nonwoven cloth which forms the trap member. The surplus processing solution caught by the nonwoven cloth is neutralized in polymer containing carboxyl groups. The usable quantity of the hardening agent is within a range from 1 to 30 mol % relative to the cross linkage groups of the polymer.

If the quantity were less than 1 mol %, the unhardened polymer would be eluted when the processing solution enters the trap member and the processing solution might be flocculated by the polymer. As a result, the surplus processing solution would be unable to permeate the trap member. On the other hand, if a hardening agent of more than 30 mol % were used, the carboxyl groups as acid radicals contributing to a neutralization reaction would react in large quantity and lose an acidic function. As a result, the neutralization function would be seriously jeopardized. In this way, as the permeation of the surplus processing solution to the trap member is not disturbed owing to the use of a proper quantity of the hardening agent, occurrence of leakage caused by a bypassing of the surplus processing solution can be prevented. Also, as the processing solution caught by the trap member is neutralized with the neutralizing agent, even if surplus processing solution should be returned to a nearby portion of the exposure opening, no change of color of an image would occur at this portion.

A second embodiment of the invention utilizes a fiber constituting an external layer composed of a hydrophilic cross linkage polymer, and an internal layer composed of an acrylonitrile type polymer and/or other polymers, and containing therein a polymer of 0.5 to 5.0 mmol/g having carboxyl groups. A nonwoven cloth mixed with 50 to 200 g/m$^2$ of the polymer having carboxyl groups is used as the trap member. In this embodiment, the surplus processing solution caught by the trap member is neutralized with the polymer having the carboxyl groups and is absorbed into the hydrophilic cross linkage polymer. The fibers of the nonwoven cloth have a large area of contact with the surplus processing solution. Further, these fibers contain the polymer having the carboxyl groups and the hydrophilic cross linkage polymer. As a result, a neutralization reaction and a water absorption reaction are effected rapidly, and leakage of the processing solution and change of color of an image in the nearby portion of the frame of the image forming plane can be prevented. The polymer having the carboxyl groups preferably is contained in or attached to the external layer.

A third embodiment of the invention uses a trap member in which an inlet side portion (a lower portion) for the surplus processing solution has a low density and the opposite side (an upper side) thereof has a high density. The density change from the lower side to the upper side may be either stepwise or continuous. In this embodiment, the surplus processing solution is caught by the low density portion of the trap member and is absorbed into the trap member by capillary action. As the upper layer has a high density in this trap member, the surplus processing solution absorbed into this layer is drawn there and stays there. As a consequence, the surplus processing solution never passes through the trap member or bypasses the trap member to cause leakage. Further, no change of color of an image occurs in the nearby portion of the frame portion.

The stepwise density change is obtained by using two or more kinds of nonwoven cloth having different density and overlaying them, one upon the other. To obtain the layers, a plurality of nonwoven cloths may be attached together by an adhesive agent or heat-welded together (for nonwoven cloths having hot-melting properties. It is preferable that the density of the nonwoven cloths are in the range from 0.02 to 0.15 g/cm$^3$ on the inlet side, from 0.12 to 0.65 g/cm$^3$ on the upper side, and from 0.07 to 0.4 g/cm$^3$ for the entire trap member on average.

In order to provide a continuous density change to the nonwoven cloths, according to a thermal bonding method for making a nonwoven cloth using a pair of heat rollers, for example, the temperature of one of the rollers may be set higher than that of the other. The degree of the density change, as in the aforementioned stepwise density change, may be in the range from 0.12 to 0.65 g/cm$^3$ for the maximum density and from 0.02 to 0.15 g/cm$^3$ for the minimum density.

A fourth embodiment of the invention is designed such that the average dimension of individual spaces formed between fibers in the nonwoven cloths is larger on the inlet side (lower portion) of the trap member than on the upper portion thereof. The change in average dimension of the individual spaces may be either in a continuous or stepwise manner. For example, in order to provide a stepwise change, the arrangement may be such that a plurality of nonwoven cloths having fibers of different thicknesses are used and are connected together in such a manner that nonwoven cloths having thin fibers are placed on the upper side. Otherwise it may be arranged such that a sheet of nonwoven cloth is divided into a plurality of layers, each layer having a different fiber thickness. The latter nonwoven cloth can be produced so that thick fibers are scattered and then thin fibers are scattered thereon. Such obtained cotton-like nonwoven cloth material is heated and pressurized by a heat roller. The thick fibers preferably are 8 to 15 deniers thick and the thin fibers are 2 to 6 deniers thick.

The fourth embodiment exhibits the same effect as that of the third embodiment in which density changes. That is, as the average value of the individual spaces is large on the inlet side, the surplus processing solution can be caught rapidly, and as the average value of the individual spaces is small on the upper side, the absorbed surplus processing solution can be pooled surely. If the same fibers are used, the average dimension of the individual spaces becomes small when density becomes large, but if the thickness of fibers is changed, the average dimension of each space becomes different even when the density is the same.

BRIEF DESCRIPTION OF THE DRAWINGS

The above objects and advantages will become apparent from the following detailed description of the invention when read in conjunction with the accompanying drawings wherein.

DETAILED DESCRIPTION OF THE PREFERRED EMBODIMENTS

Figure 7:
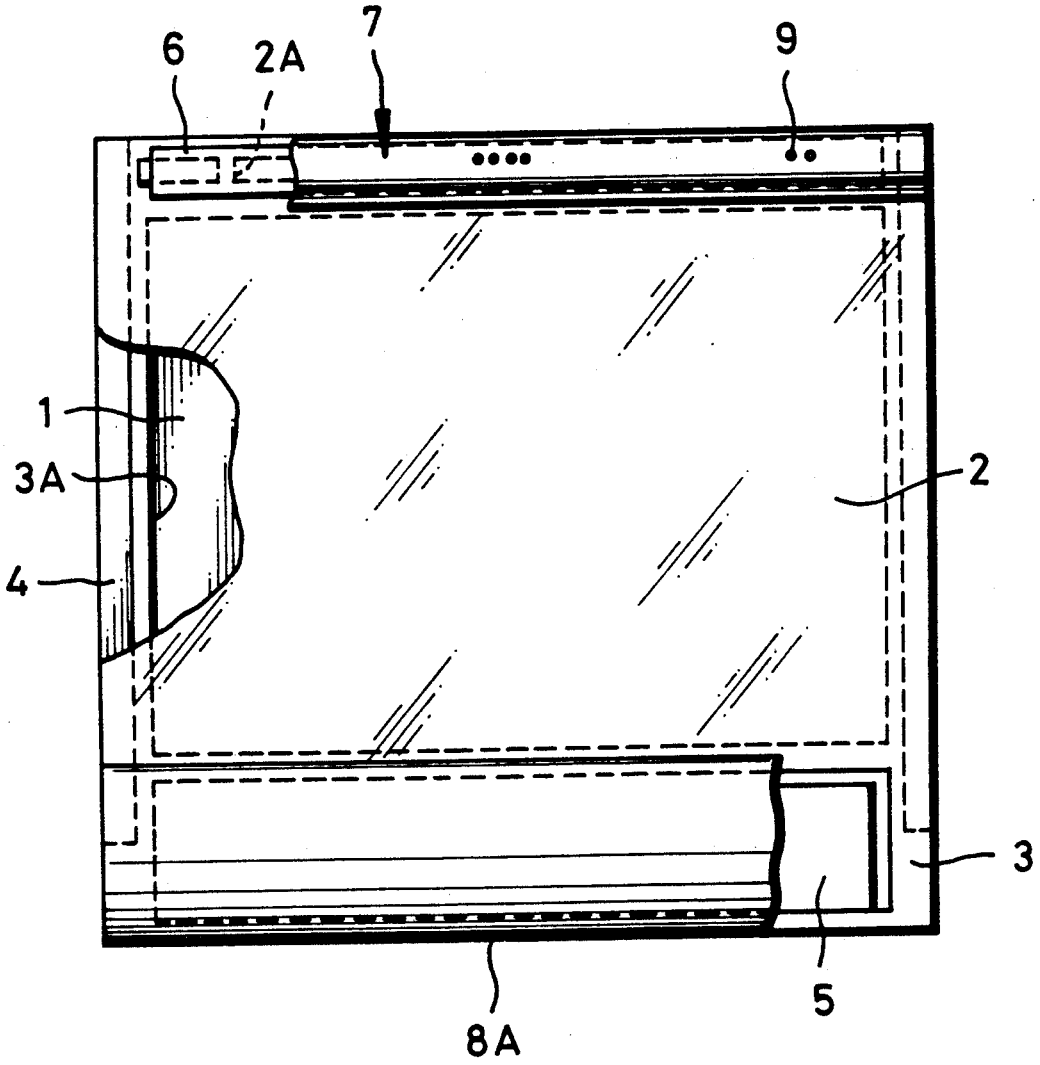
FIG. 7 (PRIOR ART)
FIG. 7 is a partly cut-away plan view of a conventional film unit.

The inventive film unit has the same construction as that of the conventional film unit shown in FIG. 7 except for the trap member. That is, the film unit includes a photosensitive sheet 1 having a photosensitive layer and an image receiving layer laminated together, a transparent cover sheet 2, a mask sheet 3, and a processing solution container 5.

Figure 1:
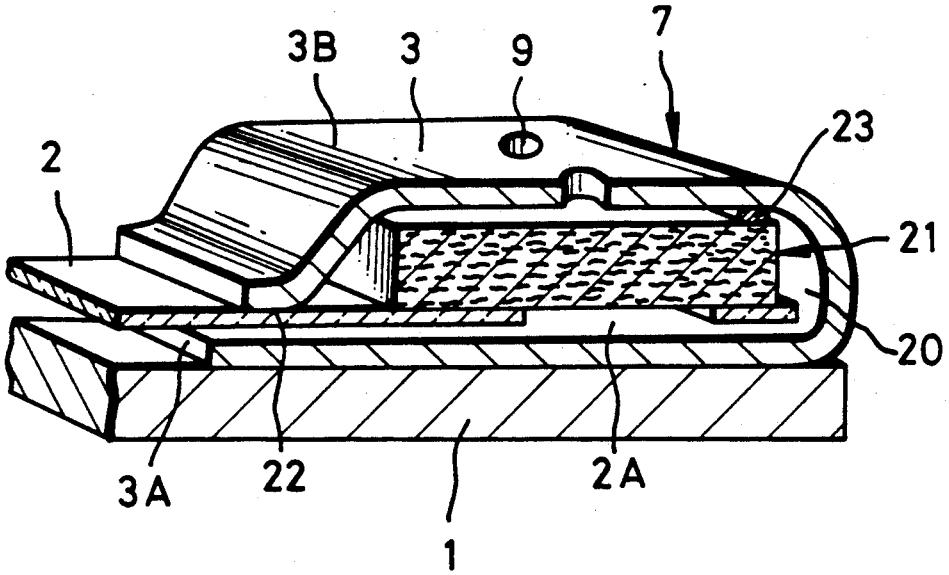
FIG. 1 is a cut-away perspective view of a trap structure of a film unit according to the invention.

As shown in FIG. 1, a trap section 7 has a clearance formed by folding back a rear end portion of the mask sheet 3 extending beyond the rear ends of the photosensitive sheet 1 and the cover sheet 2 toward the central side of the unit, and also has a belt-like trap member 21 disposed therein. The clearance 20 is formed by attaching both lateral margins (the right and left side margins in FIG. 7) of the mask sheet 3 to the cover sheet 2 and a rear margin of the mask sheet 3 to the cover sheet 2. A sealed portion 22 of the rear margin and a folded portion 3B of the mask sheet 3 also are shown. Also, in order to discharge air contained in the clearance 20 outside, the folded portion 3B is provided with a plurality of tiny discharging holes 9.

The trap member 21 is attached to the cover sheet 2 at one portion thereof with an adhesive agent 23, and is disposed on a number of openings 2A formed in a series at the rear portion of the cover sheet 2. Therefore, when processing solution spreads between the photosensitive sheet 1 and the cover sheet 2, surplus processing solution passes through the openings 2A and flows into the clearance 20.

There are two methods for preventing leakage from the air discharging holes 9 and change of color at a frame portion of the image plane. One method is to apply a chemical treatment to the trap member 21, and the other method is to improve the physical properties thereof. Both methods can achieve favorable effects. In particular, if these two methods are employed together, leakage and change of color can be prevented more effectively.

One embodiment of the invention in which a chemical treatment is applied to the trap member 21 will be described first. To prevent a possible change of color at the frame portion, the trap member 21 is impregnated with a neutralizing agent, and the surplus processing solution neutralized to lose its processing ability. If this is done, even if a part of the surplus processing solution caught in the trap member 21 should return to an exposure opening 3A, the frame portion is never changed in color, because an image dye precursor is never decomposed nor scattered. A polymer having carboxyl groups is used as the neutralizing agent, and is attached to a nonwoven cloth used as the trap member 21.

The polymer having carboxyl groups is eluted when the surplus processing solution enters the trap member 21, thereby to flocculate the surplus processing solution in order to prevent it from permeating the nonwoven cloth. Therefore, in order to harden the polymer having carboxyl groups, a hardening agent in a range from 1 to 30 mol % is used relative to cross linkage groups of the polymer. Also, this hardening agent causes the polymer to be bridged in order to form a mesh structure at the molecular level. Accordingly, the surplus processing solution enters this mesh structure and is held firmly by the mesh structure. In this way, as the surplus processing solution is held firmly, even if a processed film unit is left in an environment with a temperature as high as 60° C. and a relative humidity of 80%, or a fading test of an image is effected, no change of color of the image occurs to the periphery of the frame portion.

The polymer having carboxyl groups may be a polymer of an acrylic acid, a methacrylic acid or a maleic acid and a partial ester thereof or an acid anhydride as disclosed in U.S. Pat. No. 3,362,819, or a copolymer of an acrylic acid and an acrylic acid ester as disclosed in French Patent No. 2,290,699, and a higher fatty acid such as an oleic acid as disclosed in U.S. Pat. No. 2,983,606, and a latex type acid polymer as disclosed in "Disclosure" No. 16102 (1977), etc. However, the polymer having carboxyl groups is not so limited.

The hardening agent may be any such agent having reactivity with the carboxyl groups, for example, those described in "Functional Acrylic Type Resin" (issued by Techno System Co., Ltd., written by Hidezo Omori), pp. 311 to 320. Among them, if an epoxy type hardening agent is used, a favorable effect can be obtained. These hardening agents preferably are in a range from 1 to 30 mol % and more preferably in a range from 3 to 10 mol % relative to the cross linkage groups of the polymer to be used.

Also, hot-melting fibers such as a polyester, a nylon, an acrylic fiber, a polypropylene, a rayon, etc. may be used for the fibers in the nonwoven cloth. The thickness of the fibers preferably is 2 to 15 deniers, but is not particularly limited to this range.

The nonwoven cloth preferably is hard so that the surplus processing solution does not flow once it is caught, even if the folded portion 3B is depressed with a finger, etc. after being processed. For this purpose, it is preferable that there are as many connected points as possible where the fibers are tightly connected together. There are many methods for making a nonwoven cloth. In order to obtain such connected points, it is preferable to employ a resin treatment method in which the fibers are connected together through an adhesive agent, or a thermal bonding method in which hot-melting fibers having a low softening point (100° to 200° C.) is used as all or part of a nonwoven cloth material and the hot-melting fibers are melted to connect the fibers together.

Figure 2:
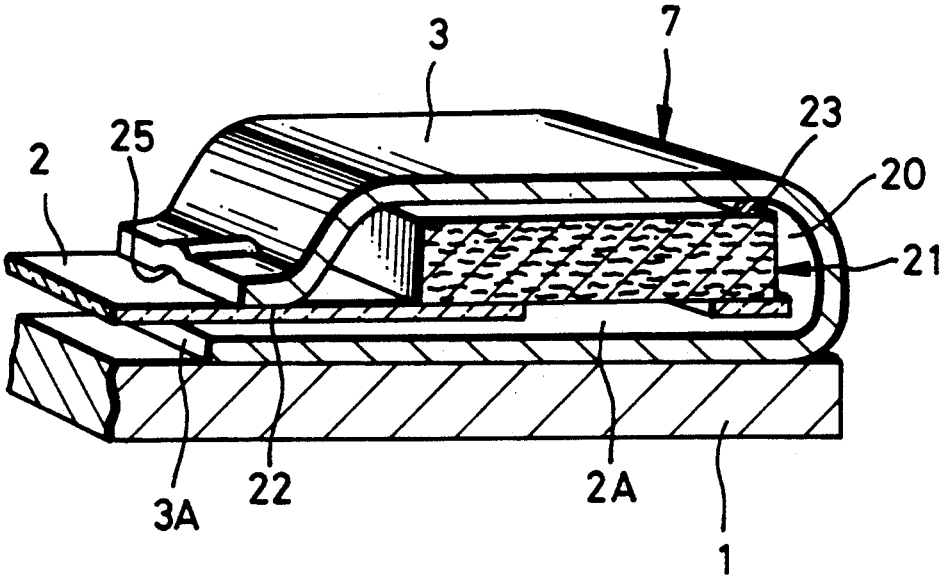
FIG. 2 is a perspective view in which an air discharging hole is provided between a cover sheet and a mask sheet in the trap structure of FIG. 1.

Also, in the trap section 7 shown in FIG. 2, the mask sheet 3 has at least one air discharging hole 25 formed in a sealed portion 22 where the front end of the folded portion 3B of the mask sheet 3 and the cover sheet 2 are attached together. This air discharging hole 25 can be formed by providing a non-sealed portion partially in the sealed portion 22. The components which are the same as those shown in FIG. 1 have the same reference numerals.

An embodiment in which a nonwoven cloth applied with the above-described chemical treatment is used as a trap member now will be described in greater detail with reference to comparative examples.

COMPARATIVE EXAMPLE 1-1

A film unit having a trap section of the structure shown in FIG. 1 was made. The specifications of the trap section are as follows:

(1) The hollow interior portion of the trap section has a volume of 0.35 cc.

(2) The trap member is a nylon woven cloth having fibers 210 deniers thick, with a mesh of $12\times8.5$, attached with 560 mmol/m$^2$ of phosphoric acid, and a polyethylene having a thickness of 25 $\mu$ bonded to the upper surface thereof as a permeation resisting layer.

The trap member was set in the trap section so that the woven cloth would be disposed on openings 2A.

COMPARATIVE EXAMPLE 1-2

A film unit having a trap section of the structure shown in FIG. 2 was made. The specifications of the trap section are the same as those of COMPARATIVE EXAMPLE 1-1.

COMPARATIVE EXAMPLE 1-3

A film unit having a trap section of the structure shown in FIG. 1 was made. The specifications of the trap section are as follows:

(1) The hollow interior portion of the trap section has a volume of 0.35 cc.

(2) The trap member is a nylon woven cloth having fibers 210 deniers thick, with a mesh of 12×8.5, attached with 560 mmol/m$^2$ of phosphoric acid, and disposed on an inlet side of the surplus processing solution, a polyethylene having a thickness of 25 μ being bonded to the upper surface thereof as a permeation resisting layer, and a tetron woven cloth having fibers 50 deniers thick, with a mesh of 19×16 being further bonded on the polyethylene film.

COMPARATIVE EXAMPLE 1-4

A film unit having a trap section of the structure shown in FIG. 2 was made. The specifications of the trap section are the same as those of COMPARATIVE EXAMPLE 1-3.

COMPARATIVE EXAMPLE 1-5

A film unit having a trap section of the structure shown in FIG. 1 was made. The specifications of this trap section are as follows:

A MARIX 21608WTV (merchandise name, manufactured by Unitika Ltd.) was used for the nonwoven cloth. This MARIX 21608WTV is a resin processing type nonwoven cloth obtained by bonding fibers of 100% polyester together with a polyvinyl alcoholic resin, the density of which is 0.28 g/cm$^3$ and the thickness of which is 580 μm. A polyacrylic acid (manufactured by Nihon Junyaku Co., Ltd., merchandise name: JULIMER AC10L) was diluted with methanol so that the condensation of the polyacrylic acid would become 15%. This solution impregnated the nonwoven cloth so that its solid component would be attached at a rate of 50 g/m$^2$. Then, after the nonwoven cloth was dried at a temperature of 100° C. for 10 minutes, the cloth was used as a trap member. This trap member is the same as that which is obtained by omitting an epoxy hardening agent and NaOH from the trap member of EMBODIMENT 1-1 of the present invention.

COMPARATIVE EXAMPLE 1-6

A film unit shown in FIG. 2 was made, having a trap section with the same specifications as those of COMPARATIVE EXAMPLE 1-5.

EMBODIMENT 1-1

A film unit having a trap section having the structure shown in FIG. 1 was made. The specifications of this trap section are as follows;

A MARIX 21608WTV was used for the nonwoven cloth, as in the COMPARATIVE EXAMPLE 1-5. A polyacrylic acid (manufactured by Nihon Junyaku Co., Ltd., merchandise name: JULIMER AC10L) was added with 5 mol % of an epoxy hardening agent (manufactured by CIBA-GEIGY Limited. merchandise name: ARALDITE DY 0-22) and 5 mol % of NaOH relative to the polyacrylic acid, and the result was diluted with methanol to prepare a solution of 15% condensation of the polyacrylic acid. This solution was impregnated into the nonwoven cloth so that its solid component would be attached at a rate of 50 g/m$^2$. Then, after the nonwoven cloth was dried at a temperature of 100° C. for 10 minutes, the cloth was used as a trap member.

EMBODIMENT 1-2

A film unit of the structure shown in FIG. 2 was made, having a trap section with the same specifications as those of EMBODIMENT 1-1.

EMBODIMENT 1-3

A film unit of the structure shown in FIG. 1 was made, with a trap section in which a nylon woven cloth having a thickness of 0.2 mm. a fiber thickness of 150 deniers, and a mesh of 12×8.5, was bonded with the same nonwoven cloth as that in EMBODIMENT 1-1, and disposed on the openings 2A.

EMBODIMENT 1-4

A film unit of the structure shown in FIG. 2 was made, with a trap section having the same specifications as those of EMBODIMENT 1-3

A test for leakage of the surplus processing solution and change of color in the frame portion was performed on each of the above-mentioned test samples. The surplus processing solution leakage test was carried out in the following manner. Test samples, in which the capacity for the surplus processing solution was 0.240 cc at 20° C., were left for two hours under conditions of 25° C./65% RH, and 40° C./80% RH, Processing was performed under conditions of 20° C./65% RH, and then a load of 1000 g was applied immediately to the upper surface of each trap section, and then Was checked visually for any leakage of the surplus processing solution from the air discharging holes 9 and 25. The test was carried out on 20 test samples and the number of test samples in which leakage was recognized was checked.

The test for change of color of the frame portion was carried out in the following manner. Test samples, in which the capacity for the surplus processing solution was 0.240 cc at 20° C., were developed under conditions of 25° C./65% RH. After they were left for 7 days under conditions of 60° C. and 80% RH, change of color in the frame portion was checked visually. Test samples in which change of color (for example, cyan bleeding) occurred are marked with X, test samples in which change of color occurred slightly are marked with Δ, and test samples in which no change of color occurred at all are marked with O. It was confirmed, from the comparison of various conditions, that a test under conditions of 60° C./80% RH is a forced test taking place under abnormally severe conditions of high temperature and high humidity. The test results are shown in the following table:

TABLE 1

| Test samples | Leakage (samples) 25° C. 65% RH | Leakage (samples) 40° C. 80% RH | Change of color of frame portion |
|---|---|---|---|
| Comp. exam. 1-1 | 3 | 12 | X |
| Comp. exam. 1-2 | 1 | 6 | X |

TABLE 1-continued

| Test samples | Leakage (samples) 25° C. 65% RH | 40° C. 80% RH | Change of color of frame portion |
|---|---|---|---|
| Comp. exam. 1-3 | 0 | 0 | Δ |
| Comp. exam. 1-4 | 0 | 0 | Δ |
| Comp. exam. 1-5 | 1 | 5 | O |
| Comp. exam. 1-6 | 0 | 2 | O |
| Embodiment 1-1 | 0 | 0 | O |
| Embodiment 1-2 | 0 | 0 | O |
| Embodiment 1-3 | 0 | 0 | O |
| Embodiment 1-4 | 0 | 0 | O |

As is apparent from Table 1, the inventive film unit does not leak at all, even under the extreme conditions of 40° C. and 80% RH, and a remarkable improvement was obtained when compared with the trap members of the comparative examples. No occurrence of change of color was confirmed in the frame portion, either. Comparative examples 1-5 and 1-6 show examples in which an unhardened polyacrylic acid was used. It can be seen that leakage occurred compared with each embodiment where a hardening agent was used. Furthermore, the manufacturing cost of the invention is low because an inexpensive nonwoven cloth with a neutralizing agent and a hardening agent attached thereto is used as a trap member.

Figure 3:
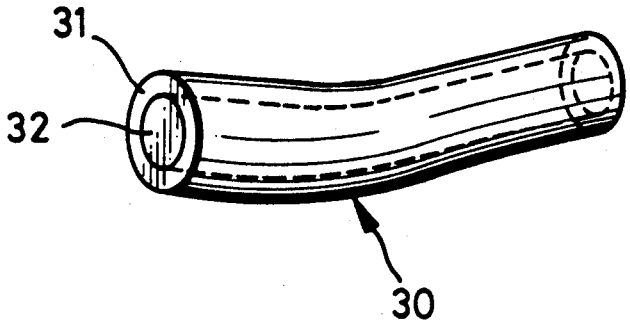
FIG. 3 is a perspective view showing a duplex structure of fibers.

By improving the construction of fiber material of the nonwoven cloth, leakage and change of color of the frame portion can be prevented. This will be described next. As shown in FIG. 3, a fiber 30 used in the nonwoven cloth includes an external layer 31 composed of a hydrophilic cross linkage polymer, and an internal layer 32 composed of an acrylonitrile type polymer. The fiber 30 contains 0.5 to 5.0 mmol of acid type carboxyl groups per 1 g of fiber. Such fiber is manufactured by a method as disclosed in Japanese Patent Publication No. Sho 58-10509. Although a salt type carboxyl group represented by —COOX (X: alkali metal or $NH_4$ is used in this manufacturing method, this can easily be replaced with an acid type carboxyl group —COOH by an acid such as HCl. For example, a LANSEAL FA type and a weak acid type ion exchange fiber N-20 manufactured by Japan Exlan Co., Ltd. is commercially available. These fibers are different in content of the acid type carboxyl groups per 1 g of fiber depending on the type or kind, and the thicker the fiber, the larger the content.

The afore-mentioned fibers of a duplex structure are mixed with hot-melting fibers having a generally available low melting point (100° to 200° C.). The mixture is heated and pressurized by a pair of heat rollers to make a nonwoven cloth according to a thermal bonding method. Fibers containing a polyolefin type and a polyester type can be used as the hot-melting fiber. If the ratio of the hot-melting fiber is too large, then the ratio of the acrylic fiber containing the acid type carboxyl groups is lowered, and it becomes difficult to obtain a sufficient quantity of acid type carboxyl groups required for neutralizing the alkaline processing solution. On the contrary, if the ratio of the hot melting fiber is too small, the bonding between the fibers becomes insufficient, and waste yarn, etc. is generated when the trap member is produced. Accordingly, the ratio of the hot-melting fiber preferably is 10% to 80% of the whole. The fibers may be bonded together to manufacture the nonwoven cloth in accordance with a resin treatment method instead of the thermal bonding method.

In order to prevent the surplus processing solution from penetrating the trap member fully when the surplus processing solution is spread, the density must be increased to reduce the average diameter of tiny gaps formed in the nonwoven cloth. The expression "average diameter of the tiny gaps" herein refers to the diameter of the average size of individual spaces as imaginary holes which are formed between a plurality of fibers. However, if the density is increased significantly, the average diameter of the tiny gaps becomes too small. As a result, the solution absorbing ability is lowered when the processing solution is being spread, and the surplus processing solution surrounds the trap member. As a consequence, the processing solution leaks from the air discharging holes. If the density is too small, the average diameter of the tiny gaps becomes large and as a result, the surplus processing solution penetrates fully through the nonwoven cloth and leaks from the air discharging holes. Also, it becomes impossible to obtain a sufficient quantity of the acid type carboxyl group required for neutralizing the alkaline processing solution. The result is that the absorbed processing solution remains in a non-neutralized state, and accordingly peeling of the seal portion 22 occurs, and leakage and change of color of the frame portion occur. In view of the foregoing, the trap member is formed of a nonwoven cloth containing fibers within a range from 50 to 200 g/m$^2$ as have 0.5 to 5.0 mmol/g of carboxyl groups.

Next, an embodiment using fibers of a duplex structure will be described in greater detail.

EMBODIMENT 2-1

The trap section has the structure shown in FIG. 1. 150 g/m$^2$ of weak acid type ion exchange fibers N-20, having a fiber fineness of 8 deniers, and manufactured by Japan Exlan Co., Ltd. were mixed with 25 g/m$^2$ of SOLSTAR M53, having a fiber fineness of 4 deniers, and manufactured by Mitsubishi Rayon Co., Ltd., and then the mixture was pressed with a heat roller for a total thickness of 0.6 mm. A nonwoven cloth manufactured by this thermal bonding method was used as a trap member.

EMBODIMENT 2-2

The trap section has the structure shown in FIG. 2. The same trap member 21 as that of Embodiment 2-1 was used.

A leakage test and a test for change of color of the frame portion were performed on the test samples of the above-mentioned embodiments, and on the test samples of the above-mentioned comparative examples. Furthermore, a sealing power test was carried out with respect to the seal portion 22. This seal portion 22 invites poor sealing when subjected to a high pH condition for a certain time period and causes leakage. The time for the seal portion 22 to be subjected to the high pH condition is related to a neutralizing speed of the surplus processing solution. If the neutralizing speed is slow, the time for the seal portion 22 to be subjected to the high pH condition is long and sealing power is lowered. This sealing power test was carried out as follows. After the processing solution was spread, the various test samples were left for one day under conditions of 25° C. and 65% RH. Then, the sealing power of the seal portion 22 was measured with a TENSILON. This sealing power was represented in grams (g). The width of the seal portion 22 is 1 mm.

TABLE 2

| Test samples | Leakage (samples) 25° C. 65% RH | 40° C. 80% RH | Change of color of frame | Sealing power |
|---|---|---|---|---|
| Comp. exam. 1-1 | 3 | 12 | X | 250 |
| Comp. exam. 1-2 | 1 | 6 | X | 200 |
| Comp. exam. 1-3 | 0 | 0 | Δ | 300 |
| Comp. exam. 1-4 | 0 | 0 | Δ | 280 |
| Embodiment 2-1 | 0 | 0 | O | 500 |
| Embodiment 2-2 | 0 | 0 | O | 500 |

As is apparent from this Table 2, the inventive film unit does not leak, and does not change color in the frame portion at all, even under the extreme conditions of 40° C. and 80% RH. The results are a remarkable improvement over the trap members of the comparative examples. Also, the sealing power apparently is improved when compared with the comparative examples. One reason for the improvement is that, as a neutralizing function is ensured in the fibers themselves forming the nonwoven cloth, the neutralizing speed of the surplus processing solution absorbed into the nonwoven cloth is fast. As a result there is a lessened effect on the seal portion 22. In this embodiment, as the fibers themselves forming the nonwoven cloth have the neutralizing function and the water absorbing function, it is no longer required, as in the prior art, that the nonwoven cloth be attached with a new acid component, etc., the manufacturing steps of the trap member can be simplified, and the manufacturing cost can be reduced. Moreover, as the nonwoven cloth is manufactured after the fibers themselves are given the above-mentioned two functions, these functions are distributed uniformly in the nonwoven cloth. Also, a contacting outer area with the surplus processing solution becomes large, and reaction of neutralization and absorption becomes quick. Owing to the foregoing, the sealing power of the seal portion is not lowered, and the absorbed surplus processing solution is not left in its unneutralized state. Accordingly, no change of color of the frame portion takes place, either.

In the above-mentioned embodiment, the nonwoven cloth or its fiber material is subjected to chemical treatment, thereby to prevent leakage and change of color of the frame portion. In addition, by improving the physical construction of the nonwoven cloth, the same operation and effects can be obtained. As just described, when the density of the nonwoven cloth is low, absorption of the surplus solution can be effected rapidly, but also there is a problem in that the surplus processing solution fully penetrates the nonwoven cloth and leaks from the air discharging holes. Also, as the surplus processing solution cannot be held tightly, when the nonwoven cloth is pushed, surplus processing solution flows out from the trap member. As a result, leakage and change of color of the frame portion are possible. Further, if a processed film unit is left for about 3 weeks in hot and humid conditions (for example, 40° and 80%), the surplus solution flows toward an image surface frame portion to change this portion in color. On the other hand, if the density of the nonwoven cloth is high, the surplus processing solution can be caught firmly. However, as the absorption of the surplus processing solution is slow, a portion of the surplus processing solution which has entered the trap section bypasses the trap member and reaches the air discharging holes, resulting in leakage. Furthermore in this high density nonwoven cloth, the surplus processing solution is pooled in the frame portion until that time and the frame portion also undergoes a color change.

Such problems can be solved by changing the density in the nonwoven cloth either stepwise or continuously. That is, the leakage and change of color of the frame portion can be prevented by reducing the density of the portion of the nonwoven cloth located at the inlet side which faces with the opening 2A, and enlarging the density of a portion located at the opposite side of the inlet side. As the absorption and holding of the surplus processing solution are related with the percentage of void, this use is correct. In this specification, density is used, as is usual in the field of nonwoven cloth. To find the void $\epsilon$ from this density $\rho$, it can easily be found from the following equation including the gravity $\rho 1$ of the fibers:

$$\epsilon = 1 - (\rho/\rho 1)$$

Figure 4:
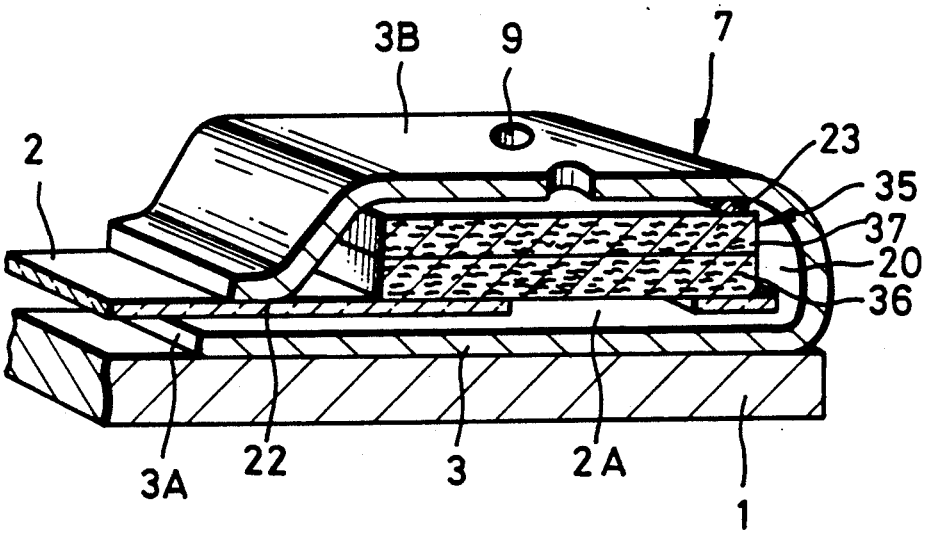
FIG. 4 is a perspective view showing the trap member of FIG. 1 formed as a combination of a plurality of nonwoven cloths having different densities.

Next, with reference to FIG. 4, an embodiment will be described in which the density of the nonwoven cloth is changed stepwise. In this embodiment, the trap member 35 comprises two layers of nonwoven cloth having different densities. The density of the nonwoven cloth forming a first layer 36 disposed at a lower side is in this first layer is about 0.3 mm. Also, the density of the range from 0.02 to 0.15 g/cm$^3$, and the thickness of the nonwoven cloth forming a second layer 37 disposed at the upper side is in the range from 0.12 to 0.65 g/cm$^3$, and the thickness is about 0.4 mm. The first layer 36 and the second layer 37 are attached together by an adhesive agent in a state keeping a favorable permeability, and the overall density is 0.07 to 0.40 g/cm$^3$. Also, in view of the convenience of containing 10 pieces of film units in a pack, the thickness of the trap member 35 is restricted and even the maximum is preferably 0.7 mm or less.

Polyester ($\rho 1 = 1.4$), nylon ($\rho 1 = 1.14$), acryl ($\rho 1 = 1.16$), polypropylene ($\rho 1 = 0.91$), and rayon ($\rho 1 = 1.5$), among others can be used for the nonwoven cloth for the respective layers 36 and 37. These fibers are bonded together by a resin treatment method, a thermal bonding method, etc. The thickness of the fibers preferably is 2 to 15 deniers, but is not particularly limited to this range.

By applying the afore-mentioned chemical treatment to this embodiment, leakage and change of color of the frame portion can be prevented more effectively. That is, it is preferable that the nonwoven cloths of the respective layers 36 and 37 be impregnated with a neutralizing agent of a polymer having carboxyl groups and a hardening agent within a range from 1 to 30 mol % relative to the cross linkage groups of this polymer. Also, this embodiment can be utilized for a film unit having an air discharging hole as shown in FIG. 2.

Next, this embodiment will be described in greater detail with reference to comparative examples.

COMPARATIVE EXAMPLE 3-1

A film unit shown in FIG. 7 was made using, as a single-layer trap member having a uniform density, AXTAR B010-11ABKO (merchandise name, manufactured by Toray Industries, Inc.). This nonwoven cloth is composed of 5 denier thick polyester fibers bonded together thermally. The fibers have a density of 0.19 g/cm$^3$.

COMPARATIVE EXAMPLE 3-2

KINOKUROSU K 60 (merchandise name, manufactured by Honshu Kinokurosu Co., Ltd.) was used for a single-layer trap member having a uniform density. This nonwoven cloth is formed of pulp attached in accordance with a spray method, and the density thereof is 0.10 g/cm$^3$.

COMPARATIVE EXAMPLE 3-3

F-50M (merchandise name, manufactured by Miki Tokushu Seishi Co., Ltd.) was used for a single-layer trap member. This nonwoven cloth was obtained by manufacturing pulp, and the density thereof is 0.58 g/cm$^3$.

EMBODIMENT 3-1

A film unit was made by integrally superposing two nonwoven cloths upon each other and using a two-layer trap member. The density of the first layer was 0.05 g/cm$^3$, and the density of the second layer was 0.20 g/cm$^3$. Nonwoven cloths of the first and second layers used polyester fibers of 2 deniers thickness.

EMBODIMENT 3-2

A two-layer trap member was used, in which the density of the first layer was 0.10 g/cm$^3$ and that of the second layer was 0.20 g/cm$^3$. Nonwoven cloths of the first and second layers were made of polyester fibers of 2 deniers thickness.

EMBODIMENT 3-3

A two-layer trap member was used, in which the density of the first layer was 0.10 g/cm$^3$ and that of the second layer was 0.35 g/cm$^3$. Nonwoven cloths of the first and second layers were made of polyester fibers of 2 deniers thickness.

EMBODIMENT 3-4

A two-layer trap member was used, in which the density of the first layer was 0.15 g/cm$^3$, and that of the second layer was 0.35 g/cm$^3$. Nonwoven cloths of the first and second layers made of polyester fibers of 2 deniers thickness.

The afore-mentioned tests for leakage and for change of color in the frame portion were made. By observing the trap portion, it was judged here whether the leakage of the surplus processing solution was caused by surplus processing solution passed through the trap member or by surplus processing solution bypassing the trap member.

The test for change of color to the frame portion was effected in the following manner: Test samples, in which the capacity for the surplus solution was 240 cc at 20° C., were spread at 25° and 65% RH. After they were left for 7 days at 60° C. and 80% RH, the change of color of the frame portion was measured with a microphotometer. In this measurement of this microphotometer, a red color filter was used. The test results are shown in the following table:

TABLE 3

| Test samples | Leakage (samples) Passed | Leakage (samples) Bypassed | Change of color of frame portion |
|---|---|---|---|
| Comp. exam. 3-1 | 15 | 0 | 0.54 |
| Comp. exam. 3-2 | 12 | 0 | 0.45 |
| Comp. exam. 3-3 | 0 | 12 | 0.50 |
| Embodiment 3-1 | 0 | 0 | 0.28 |

TABLE 3-continued

| Test samples | Leakage (samples) Passed | Leakage (samples) Bypassed | Change of color of frame portion |
|---|---|---|---|
| Embodiment 3-2 | 0 | 0 | 0.18 |
| Embodiment 3-3 | 0 | 0 | 0.15 |
| Embodiment 3-4 | 0 | 0 | 0.15 |

As is apparent from Table 3, the film unit of this embodiment did not have any leakage at all under the extreme conditions of 40°60 C. and 80% RH, and remarkable improvement was obtained compared with the trap members of the comparative examples. Also, the amount of change of color of the frame portion was smaller than that of the comparative examples. In this way, by composing the trap member with two layers of nonwoven cloths having different densities, the surplus processing solution can be caught, without fail, first by the first layer of low density when the surplus processing solution is spread, then by the second layer when the surplus processing solution caught in the first layer is successively absorbed upwardly by the higher-density second layer by capillary action. Then, the solution was held there without fail so as not to flow. In this manner, the surplus processing solution can effectively be prevented from fully penetrating and circuitously bypassing the trap member. As a result, occurrence of leakage can be prevented.

Also, because the surplus processing solution caught by the first layer is absorbed in the second layer from the first layer by capillary action and held chiefly in the second layer side, less surplus processing solution is absorbed into the first layer. Moreover, the surplus processing solution held by the higher-density second layer is restricted in its movement by capillary action. Therefore, as no surplus processing solution flows even at high temperature and humidity, and less surplus processing solution contacts the frame portion, decomposition and scattering of the image dye precursor contained in the photosensitive layer is reduced, and occurrence of change of color to the frame portion can be minimized.

Furthermore, if the trap member is formed in a multilayer (e.g. three or four) structure and the densities of the layers are arranged to increase from a lowest layer to an uppermost layer, full permeation of the surplus processing solution can be prevented more effectively. In particular, in the unit in which air discharging holes are formed in the upper surface of the trap cover as shown in FIG. 1, leakage can be prevented completely without jeopardizing the discharging function. Instead of forming the trap member in a multilayer structure like this, a trap member in which the density is continuously changed from a high density (0.12 to 0.65 g/cm$^3$) to a low density (0.02 to 0.15 g/cm$^3$) may be used.

Figure 5:
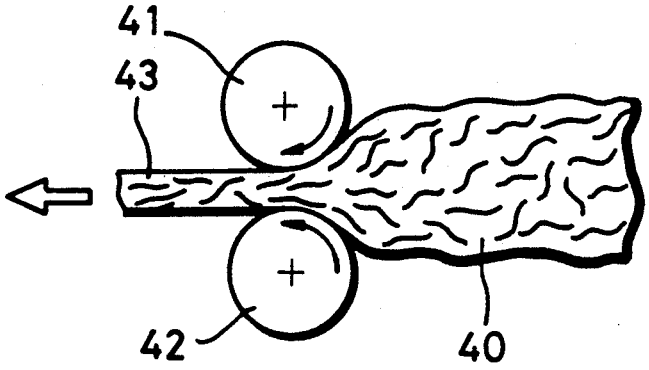
FIG. 5 is a schematic view showing an apparatus for producing a nonwoven cloth having a continuous change in density in accordance with a thermal bonding method.

FIG. 5 depicts an apparatus for making a nonwoven cloth in which the density is changed continuously utilizing a thermal bonding method. A nonwoven cloth material 40 has a cotton-like configuration, and can be formed by dispersing short fibers to a predetermined thickness. As for the fibers, hot-melting fibers having a low softening point (100° to 200° C.) such as polyester. nylon, acryl, polypropylene, rayon, etc. are used. The cotton-like nonwoven cloth material 40 is heated and pressurized by a pair of heat rollers 41 and 42 into a sheet-like nonwoven cloth 43. As the heat roller 41 is arranged to be higher in temperature here than the heat roller 42, a higher temperature is applied to a higher portion of the nonwoven cloth material 40 and the ratio of heat welding by hot melting of the fibers is raised. As a result, the nonwoven cloth 43 attains its maximum density at the upper portion and its minimum density at the lower portion, and the density changes continuously therebetween. The density may be changed continuously by passing the sheet-like nonwoven cloth (density is 0.07 to 0.40 g/cm$^3$) made by a thermal bonding method through and between the heat rollers 41 and 42 having different temperatures.

Next, further embodiments will be described in greater detail.

EMBODIMENT 4-1

Polyester type fibers (having a softening point of 110° C.) having the thickness of 4 deniers and 12 deniers were mixed together in a ratio of 7:3, and a cottonlike nonwoven cloth material was made. The nonwoven cloth material was passed between the pair of rollers 41 and 42 as shown in FIG. 5, and a sheet-like nonwoven cloth having a thickness of 0.66 mm was made. The heat roller 41 was kept at 150° C. and the other heat roller 42 was kept at 110° C.

In order to check the density distribution within the nonwoven cloth, its section was observed using a scanning electron microscope. As the density of the nonwoven cloth is continuous, the section was, for the purpose of convenience, divided into three areas (first to third areas) each having a thickness of 0.22 mm. The first area is on the side of the heat roller 41 and is within a range of the depth of 0.22 mm from the upper surface of the nonwoven cloth 43. The third area is on the side of the heat roller 42 and is within the range of the depth of 0.22 mm from the lower surface of the nonwoven cloth 43. The second area is the remaining area and has a thickness of 0.22 mm. The average densities within each area were calculated from the spatial occupation factors of the fibers. Furthermore, average size distribution of individual distance between the fibers served as the average size of the individual gaps. The measurement results are shown in Table 4.

TABLE 4

| Divided area | Density (g/cm$^3$) | Average distance between fibers (mm) |
|---|---|---|
| First area | 0.36 | 0.04 |
| Second area | 0.08 | 0.1 |
| Third area | 0.04 | 0.3 |
| Whole area | 0.28 | — |

A nonwoven cloth having such continuous change of density was used as a trap member and a film unit of the construction shown in FIG. 1 was made. The nonwoven cloth was stored in the trap member with the third area facing the openings 2A.

EMBODIMENT 4-2

The nonwoven cloth of EMBODIMENT 4-1 was impregnated with a neutralizing agent and a hardening agent as in EMBODIMENT 1-1. By using such obtained nonwoven cloth, a film unit shown in FIG. 1 was made.

EMBODIMENT 4-3

A film unit with the nonwoven cloth of EMBODIMENT 4-2 stored in the trap section shown in FIG. 2 was made.

EMBODIMENT 4-4

A nylon woven cloth was attached to the lower surface (on the side of the third area) of the nonwoven cloth of EMBODIMENT 4-2. The nylon woven cloth is 0.2 mm in width, 150 deniers in thickness and 12×8.5 in mesh. A nonwoven cloth of such construction was used as a trap member and a film unit shown in FIG. 1 was made.

EMBODIMENT 4-5

A film unit shown in FIG. 2 was made using the same nonwoven cloth as in EMBODIMENT 4-4.

With respect to these film units, the afore-mentioned leakage test and test for change of color to the frame portion were effected. It was confirmed that any one of the resulting film units exhibited excellent effects in prevention of leakage and change of color to the frame portion. In the above embodiment two kinds of fiber having different thicknesses were mixed together in order to obtain generally the same effect as in the fibers which were 8 deniers thick. Therefore, the above-mentioned effect can be obtained even if one kind of fiber is used, and fibers of three kinds or more also may be mixed together.

Although in the above-mentioned embodiment, attention is paid to the density of the nonwoven cloth, the absorbing speed and holding capacity of the surplus processing solution is related to the dimensions of individual gaps formed among the fibers. That is, if the individual gaps are large, then there can be obtained the same function and effect as in the case where the density is small, and if the individual gaps are small, then there can be obtained the same function and effect as in the case where the density is large. If the same fibers are used here, there is a correlation between the density and the individual gaps. That is, if the density is large, the individual gaps become small, and if the density is small, the individual gaps become large. However, by changing the kind of fibers or the actual thickness, the individual gaps can be changed in size even if the density is the same.

It should be noted that, as the nonwoven cloth has fibers which are intertwined, and the sizes of the individual gaps are not regular, the average is taken in actual practice. As the average value of these individual gaps cannot be measured directly, the average distance between the fibers, or the average diameter of imaginary holes (tiny holes) corresponding to the individual gaps, can be used instead as mentioned previously. The average distance between the fibers may be changed stepwise or continuously as in the afore-mentioned density. In general, it suffices if the inlet side of the trap member is about 0.5 mm and the opposite side is about 0.01 mm.

Figure 6A:
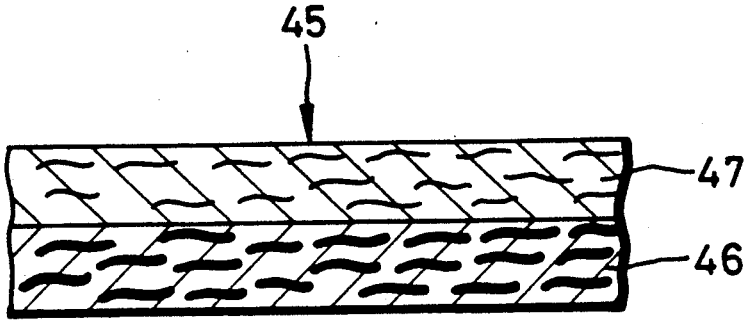
FIG. 6A is a sectional view showing a trap member of which the upper and lower portions are different in the size of individual spaces.

FIG. 6A shows an embodiment in which the individual gaps are changed in two steps. In the first layer 46 facing the inlet side, a nonwoven cloth composed of thick fibers of 8 to 15 deniers is used while in the second layer 47, a nonwoven cloth of fine fibers of 2 to 6 deniers thickness is used. These two layers 46 and 47 are integrally attached through an adhesive agent or the like, thereby to form the trap section 45.

Figure 6B:
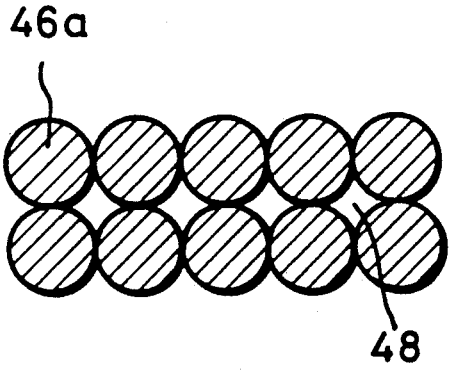
FIG. 6B shows schematically nonwoven cloths having large individual spaces.
Figure 6C:
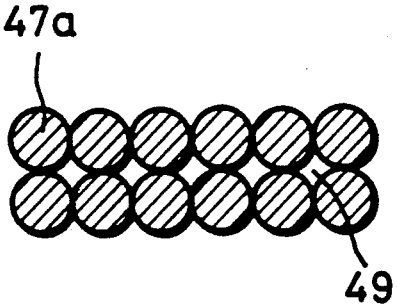
FIG. 6C shows schematically nonwoven cloths having small individual spaces.

FIG. 6B schematically shows the individual gaps in the first layer 46. In spaces among the fibers **46*a* indicated by hatching, comparatively large individual gaps 48 are formed and the surplus processing solution can be rapidly absorbed therethrough. On the other hand, as shown in FIG. 6C. comparatively small individual gaps 49 are formed in the second layer 47, and the surplus processing solution can be firmly held by the gaps 49** in order not to allow the surplus processing solution to flow. However, in the actual nonwoven cloth, as the nonwoven cloth has intertwined fibers, the individual gaps are not in such simple shapes as shown in FIGS. 6B and 6C.

The dimensions of the individual gaps may be changed in three or more steps. In this case, the thickness of the fibers in the first layer is 12 to 15 deniers, the thickness of the fibers in the second layer is 6 to 10 deniers, and the thickness of the fibers in the third layer is 2 to 4 deniers. The dimensions of the individual gaps can also be changed continuously by laminating and bonding fibers having different thicknesses one after another in accordance with the thermal bonding method.

A nonwoven cloth made in accordance with the thermal bonding method using polyester fibers of 15 deniers was used for the first layer. Likewise, a nonwoven cloth made in accordance with the thermal bonding method using polyester fibers of 4 deniers was used for the second layer. The density of the first and second layers is 0.3 g/cm$^3$. Also, the overall thickness was 0.66 mm. When this nonwoven cloth was used as a trap member, it was found that such nonwoven cloth is effective for preventing leakage and change of color to the frame portion. If the above-mentioned neutralizing agent and hardening agent are added to the nonwoven cloth of this embodiment, more remarkable effects can be obtained.

The above-mentioned embodiments are monosheet type film units which require no peeling-off operation after taking. However, the present invention likewise is applicable to a peelable monosheet type film unit as proposed in U.S. patent application Ser. No. 07/269,016. This peelable monosheet type film unit is designed such that a photosensitive sheet formed of a support member, an image receiving layer, a peelable layer, and a photosensitive layer superposed on the support member in this order is used, and the image receiving layer and the support member are peeled off through the peelable layer after the film unit has been processed. A positive image is formed on such a surface peeled off.

While the invention has been described in detail above with reference to a preferred embodiment, various modifications Within the scope and spirit of the invention will be apparent to people of working skill in this technological field. Thus, the invention should be considered as limited only by the scope of the appended claims.

What is claimed is:

1. In a self-processing photographic film unit, a trap member for catching surplus processing solution, said trap member comprising:

a nonwoven cloth for absorbing said surplus processing solution;

a neutralizing agent contained in said nonwoven cloth for neutralizing said surplus processing solution said neutralizing agent being a polymer having carboxyl groups; and a hardening agent contained in said nonwoven cloth in order to harden said polymer, said hardening agent being present in an amount of at least 1 mol % relative to cross linkage groups of said polymer.

2. A self-processing photographic film unit as claimed in claim 1, wherein said hardening agent is present in an amount no greater than 30 mol % relative to said cross linkage groups of said polymer.

3. A self-processing photographic film unit as claimed in claim 2, wherein said nonwoven cloth has a density in a range from 0.07 to 0.40 g/cm$^3$.

4. A self-processing photographic film unit as claimed in claim 3, wherein said hardening agent is an epoxy type.

5. A self-processing photographic film unit as claimed in claim 4, wherein said nonwoven cloth comprises a synthetic fiber.

6. A self-processing photographic film unit as claimed in claim 5, wherein said polymer is a polyacrylic acid.

7. In a self-processing photographic film unit, a trap member for catching surplus processing solution, said trap member comprising:

a nonwoven cloth for absorbing said surplus processing solution;

said nonwoven cloth including a fiber with an external layer of a hydrophilic cross linkage polymer and an internal layer of an acrylonitrile type polymer so as to produce a duplex structure fiber, said fiber containing 0.5 to 5.0 mmol/g of a carboxyl group, said nonwoven cloth including from 50 to 200 g/m$^2$ of said fiber and said carboxyl group being represented by —COOH having an alkali-neutralizing ability.

8. A self-processing photographic film unit as claimed in claim 7, wherein said nonwoven cloth is made in accordance with a thermal bonding method for mixing said duplex structure fiber with a hot-melting fiber and heating said duplex structure fiber therewith.

9. A self-processing photographic film unit as claimed in claim 7, wherein said nonwoven cloth is formed of said duplex structure fiber bonded together with a resin.

10. In a self-processing photographic film unit including a trap member for catching surplus processing solution, the improvement comprising:

a nonwoven cloth for absorbing said surplus processing solution, said nonwoven cloth having a density distribution such that a portion thereof on an inlet side of said surplus processing solution has a lowest density and a portion of said nonwoven cloth opposite said inlet side has a highest density.

11. A self-processing photographic film unit as claimed in claim 10 wherein said highest density is between 0.12 to 0.65 g/cm$^3$, said lowest density is between 0.02 to 0.15 g/cm$^3$, and an average density of said nonwoven cloth is from 0.07 to 0.40 g/cm$^3$.

12. A self-processing photographic film unit as claimed in claim 10, wherein said nonwoven cloth includes at least two layers of different densities.

13. A self-processing photographic film unit as claimed in claim 10, wherein said trap member comprises at least two nonwoven cloths, each having a different density.

14. A self-processing photographic film unit as claimed in claim 10, wherein said trap member is a nonwoven cloth whose density changes continuously from a first surface thereof to a second, opposing surface thereof.

15. A self-processing photographic film unit as claimed in claim 10, wherein said nonwoven cloth is continuously changed in density by pressurizing a hot-melting fiber by a pair of heat rollers having different temperatures.

16. A self-processing photographic film unit as claimed in claim 15, wherein said nonwoven cloth includes a polymer including carboxyl groups, and a hardening agent in the range from 1 to 30 mol % relative to cross linkage groups of said polymer, for hardening said polymer.

17. A self-processing photographic film unit as claimed in claim 16, wherein said hot-melting fiber comprises a mixture of thick fibers and thin fibers.

18. In a self-processing photographic film unit including a trap member for catching surplus processing solution, the improvement wherein:

said trap member comprises a nonwoven cloth for absorbing said surplus processing solution, and an average dimension of individual gaps within said nonwoven cloth has a largest value in a portion of said trap member on an inlet side of said surplus processing solution, and a smallest value in a portion of said trap member opposite said inlet side.

19. A self-processing photographic film unit as claimed in claim 18, wherein said average dimension of said individual gaps is changed continuously between said largest value and said smallest value.

20. A self-processing photographic film unit as claimed in claim 18, wherein said average dimension of said individual gaps is changed stepwise between said largest value and said smallest value.

21. A self-processing photographic film unit as claimed in claim 19, wherein said average dimension of said individual gaps is determined depending on the thickness of fibers of said nonwoven cloth.

22. A self-processing photographic film unit as claimed in claim 21, wherein said average dimension of said individual gaps is in two steps, said trap member being formed in two layers by a nonwoven cloth having a fiber 2 to 6 deniers thick and a nonwoven cloth having a fiber of the thickness of 8 to 15 deniers.

23. A self-processing photographic film unit as claimed in claim 21, wherein said nonwoven cloth includes a polymer including carboxyl groups, and a hardening agent in the range from 1 to 30 mol % relative to cross linkage groups of said polymer in order to harden said polymer.

24. A self-processing photographic film unit as claimed in claim 20, wherein said average dimension of said individual gaps is determined depending on the thickness of fibers of a nonwoven cloth.

25. A self-processing photographic film unit as claimed in claim 20, wherein said nonwoven cloth includes a polymer including carboxyl groups, and a hardening agent in the range from 1 to 30 mol % relative to cross linkage groups of said polymer in order to harden said polymer.

* * * * *